US008162438B2

(12) United States Patent
McCoy et al.

(10) Patent No.: US 8,162,438 B2
(45) Date of Patent: Apr. 24, 2012

(54) ROTARY PRINTHEAD DISC IN A ROTARY INKJET IMAGING APPARATUS

(75) Inventors: Donald Paul McCoy, Georgetown, KY (US); Mark Connelly Ott, Lexington, KY (US); David Charles Weatherly, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 636 days.

(21) Appl. No.: 12/346,989

(22) Filed: Dec. 31, 2008

(65) Prior Publication Data

US 2010/0165043 A1 Jul. 1, 2010

(51) Int. Cl.
*B41J 23/00* (2006.01)

(52) U.S. Cl. ..... 347/38

(58) Field of Classification Search ..... *B41J 2/01*
See application file for complete search history.

(56) References Cited

U.S. PATENT DOCUMENTS 4,714,936 A * 12/1987 Helinski et al. ..... 347/38
5,731,826 A * 3/1998 Hirano ..... 347/19
6,033,053 A * 3/2000 Eun ..... 347/38
6,669,332 B2 * 12/2003 Silverbrook ..... 347/54
7,052,125 B2 5/2006 Askren et al.
2006/0066656 A1 3/2006 Maher
2009/0033699 A1 * 2/2009 Han ..... 347/12

FOREIGN PATENT DOCUMENTS

JP 05124182 A * 5/1993
WO WO 2007091028 A1 8/2007

* cited by examiner

*Primary Examiner* — Stephen Meier
*Assistant Examiner* — Tracey McMillion

(57) ABSTRACT

A rotary inkjet imaging apparatus includes a carrier movable bi-directionally along a linear guide path defined adjacent to a curved print zone and extending parallel to a longitudinal axis thereof, and an inkjet printhead disc having a body and at least one and preferably multiple printhead chips integrated into its perimeter. The disc body is supported by the carrier for undergoing movement within the curved print zone along a curved path winding about a central axis extending parallel to the guide path and coaxial with the longitudinal axis of the curved print zone such that the disc body moves about the central axis multiple revolutions and the printhead chips print on the page concurrently as the carrier unidirectionally moves along the linear guide path and the disc body moves within the curved print zone and through portions of the curved path in which the chips face toward the page.

14 Claims, 4 Drawing Sheets

ROTARY PRINTHEAD DISC IN A ROTARY INKJET IMAGING APPARATUS

CROSS REFERENCES TO RELATED APPLICATIONS

This patent application is related to U.S. patent application Ser. No. 12/187,002 filed Aug. 6, 2008 and entitled, Rotary Inkjet Imaging Apparatus and Method for Printing on a Stationary Page of Media in a Curved Configuration, the entirety of which is hereby incorporated by reference.

BACKGROUND

1. Field of the Invention

The present invention relates generally to inkjet printing and, more particularly, to a rotary printhead disc in a rotary inkjet imaging apparatus.

2. Description of the Related Art

An imaging apparatus such as an inkjet printer, forms an image on a page of print media by ejecting ink from a plurality of ink jetting nozzles of an inkjet printhead to form a pattern of ink dots on the page. Such an inkjet printer typically includes a reciprocating printhead carrier that transports one or more inkjet printheads across the page along a bi-directional scanning path defining a print zone of the printer.

Market pressures continue to drive improvements in print speed and print quality. There are well-known barriers inhibiting the achievement of rapid printing of high quality inkjet images when using conventional swathing inkjet printheads. For instance, a significant fraction of total print time is dedicated to acceleration and deceleration of the printhead between printing passes. The necessity to camouflage systematic dot placement errors caused by printhead and motion control errors typically requires that each row of pixels (print grid cells) be printed with multiple nozzles. This in turn requires passing the printhead over a given row of pixels several times and advancing the page of media by a fraction of a swath height between passes. Total print time increases as the number of passes increases. Conventional swathing inkjet printers are susceptible to print quality problems due to the reciprocating motion. For example, printhead carrier vibrations during and after each acceleration induce dot placement errors. Reversal of the print direction in successive passes causes noticeable changes in dot shape so that two color tables are necessary for bi-directional printing. Ink dry time is comparable to the printhead turnaround time so dots from the immediately previous pass are wet at one end of the print swath and dry at the other end, a circumstance that can cause undesirable color effects. The paper feed mechanism is susceptible to advance distance variations both across the page width and between successive advances. The importance of paper feed inaccuracies has only increased as print speed requirements have driven manufacturers toward larger silicon printhead chips. All these errors contribute to color, grain, and banding defects.

An ideal multi-pass printhead would be one that achieves the following goals: (1) minimize non-printing time; (2) do multi-pass printing in the same time it takes to do single-pass printing, and (3) eliminate the motion control difficulties inherent in reciprocating printhead motion and incremental paper feed during printing. An ideal device that achieves these goals would be capable of a significant performance improvement compared to a conventional reciprocating printer.

One recent approach as an alternative to the conventional multi-pass swathing printhead is the provision of an inkjet drum printing arrangement in which a printhead moves linearly parallel to the axis of drum rotation as the drum rotates, causing image placement in a helical pattern on the drum after which, once the entire image is on the drum, a page of print media is rolled against the drum under pressure, causing transfer of the image to the page. This arrangement is disclosed in U.S. Pat. No. 7,052,125 assigned to the assignee of the present invention. While this alternative approach might be judged as a step in the direction toward achieving multi-pass printing as the printhead traverses the length of the drum once per page, it is more complicated than desired in view of the two-stage printing process.

Another alternative approach recently introduced in the marketplace is the provision of an array of multiple silicon printhead chips arranged to print a complete page width at once. In such a printer the print medium is fed continuously past the stationary page-wide printhead. High print speed can be achieved at the cost of a large number of silicon chips. This printing arrangement does not lend itself to multi-pass printing so it is susceptible to noticeable banding defects if one or more nozzles fail to jet properly.

Thus, there is still a need for an improved high-speed printing system.

SUMMARY OF THE INVENTION

The present invention in conjunction with the invention of the above cross-referenced patent application meets this need by providing innovations that take additional steps beyond those exemplified by the first abovementioned alternative approach as well as beyond conventional swathing printheads. These innovations allow faster and higher quality multi-pass printing than conventional swathing printheads using a similar moderate number of nozzles. The innovation of the present invention provides a rotary printhead disc having at least one and preferably a plurality of inkjet chips integrated into a single printhead body which print while concurrently moving generally in revolving paths along a stationary page within a generally curved print zone and, more particularly, moving in helical paths along a stationary page within a cylindrical print zone. Non-printing time is minimized because printhead motion is continuous and the printhead need not be decelerated and accelerated during printing, and because the printhead may be in position to print onto the print medium during a high fraction of the total print time. Print uniformity is enhanced because the motion control task simplifies to the accurate coordination of constant-velocity rotational and linear printhead motion. All printhead carrier acceleration/deceleration and paper feed accuracy issues inherent in the reciprocating design are avoided. Print uniformity is further enhanced because printing is unidirectional, hence the shift in the relative location of main and satellite dots typically observed in bi-directional printing is avoided and only one dot shape is made on the page. The imaging apparatus is mechanically simpler than the first abovementioned alternative approach because it prints the image directly onto the page and not on an intermediate transfer drum. If the inkjet nozzle arrays are arranged substantially parallel to the longitudinal axis of the helical motion then multi-pass printing may be accomplished in little or no additional time compared to one-pass printing with conventional reciprocating printers.

Accordingly, in an aspect of the present invention, a rotary inkjet imaging apparatus includes a curved print zone having a longitudinal axis and in which a page of media can be held in a curved configuration at stationary position about the axis, a carrier assembly including a carrier movable bi-directionally along a substantially linear guide path defined adjacent to the curved print zone and extending substantially parallel to the longitudinal axis thereof, and an inkjet printhead disc having a body and at least one printhead chip on a perimeter of the body. The printhead disc body is supported by the carrier which provides for disc rotation and linear movement within the curved print zone along a path extending parallel to the linear guide path and coaxial with the longitudinal axis of the curved print zone. The inkjet printhead disc body rotates about the central axis multiple revolutions and the printhead chip prints on the page concurrently as the carrier unidirectionally moves along the linear guide path and the printhead disc body carries the printhead chip within the curved print zone and through portions of the curved path in which the printhead chip faces toward the page. In a particularly advantageous embodiment of the present invention, the printhead disc has a plurality of the printhead chips integrated in and supported by the disc body in a spaced apart and generally symmetrical relationship with respect to each other about the central axis. Each of the printhead chips includes an array of ink jetting nozzles defined along an axis extending generally parallel to the central axis and facing outwardly.

In another aspect of the present invention, a rotary inkjet printhead disc includes a printhead body of annular configuration and having an circumferential surface and a central rotation axis, and a plurality of inkjet chips spaced apart from one another and integrated into printhead body along and about the circumferential surface of the body and radially outward from the central rotation axis. Each chip has an array of ink jetting nozzles facing outwardly away from the circumferential surface of the body and radially from the central rotation axis of the body and defined along an axis extending generally parallel to the central rotation axis.

BRIEF DESCRIPTION OF THE DRAWINGS

Figure 1:
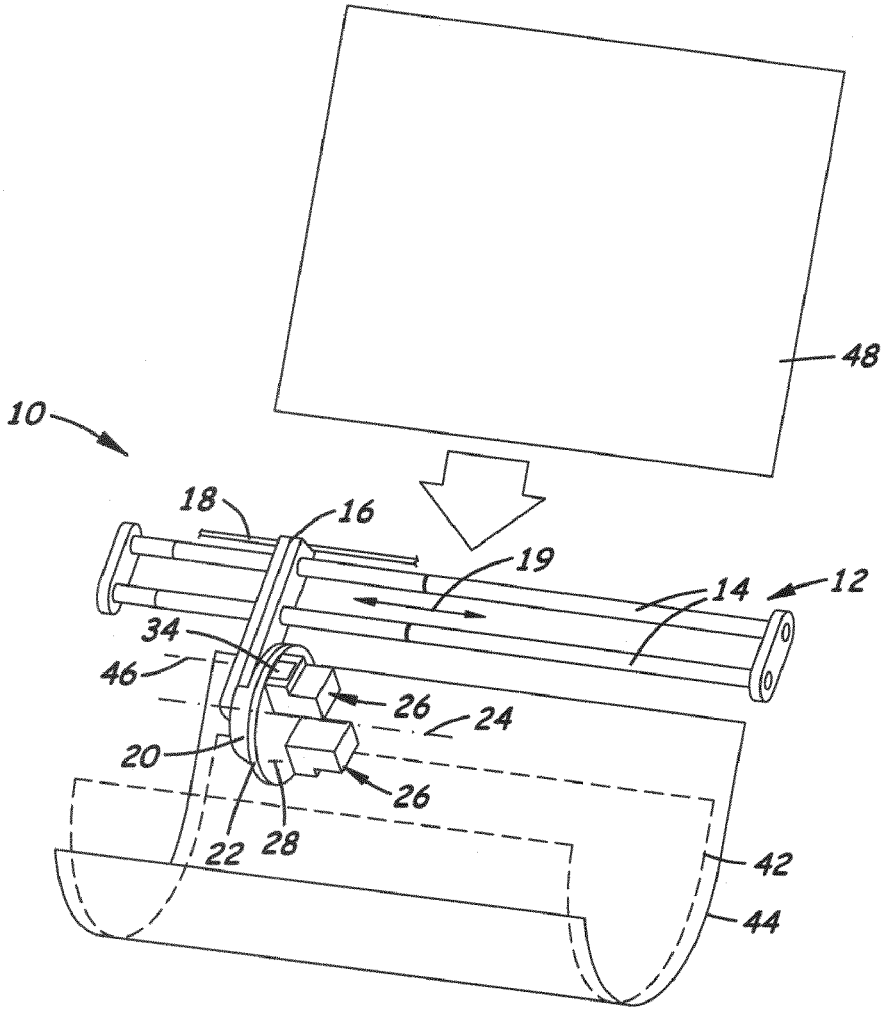

Having thus described the invention in general terms, reference will now be made to the accompanying drawings, which are not necessarily drawn to scale, and wherein:

FIG. 1 is a perspective view of an exemplary embodiment of a rotary inkjet imaging apparatus according to the invention of the above cross-referenced patent application showing advancement of a page into a curved, for example substantially cylindrical, print zone of the apparatus where the page is held in a stationary position during printing.

Figure 2:
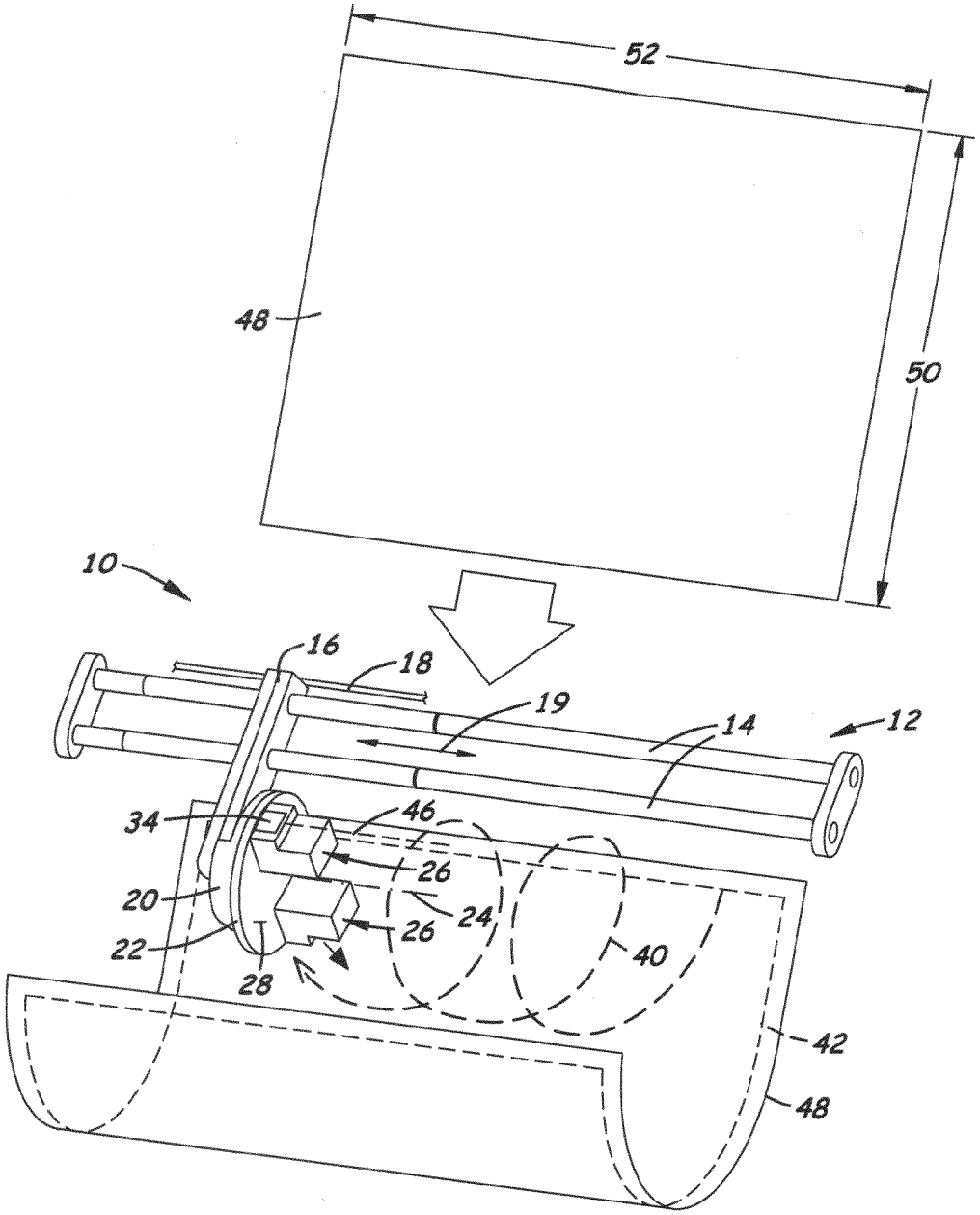

FIG. 2 is another perspective view of the rotary inkjet imaging apparatus with emphasis now on the way printheads of the apparatus concurrently revolve about a central axis along the stationary page and proceed axially through the curved print zone.

Figure 3:
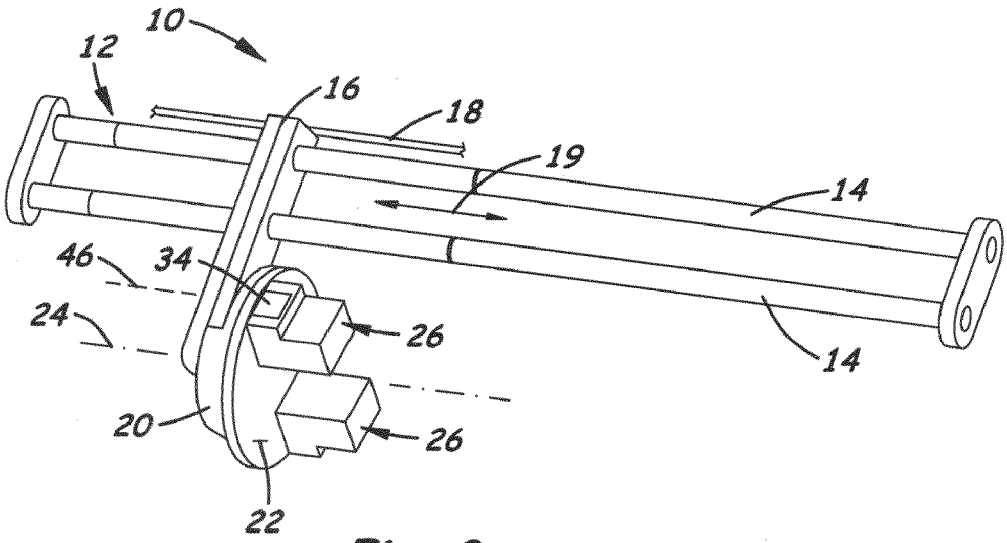

FIG. 3 is still another perspective view of the rotary inkjet imaging apparatus now highlighting the different components of the apparatus.

Figure 4:
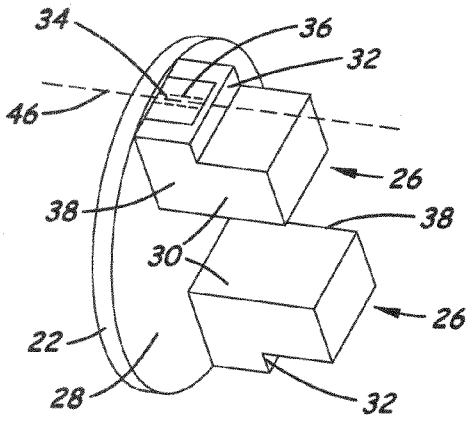

FIG. 4 is a perspective view of a printhead holding device of the apparatus removed from the platform of the apparatus.

Figure 5:
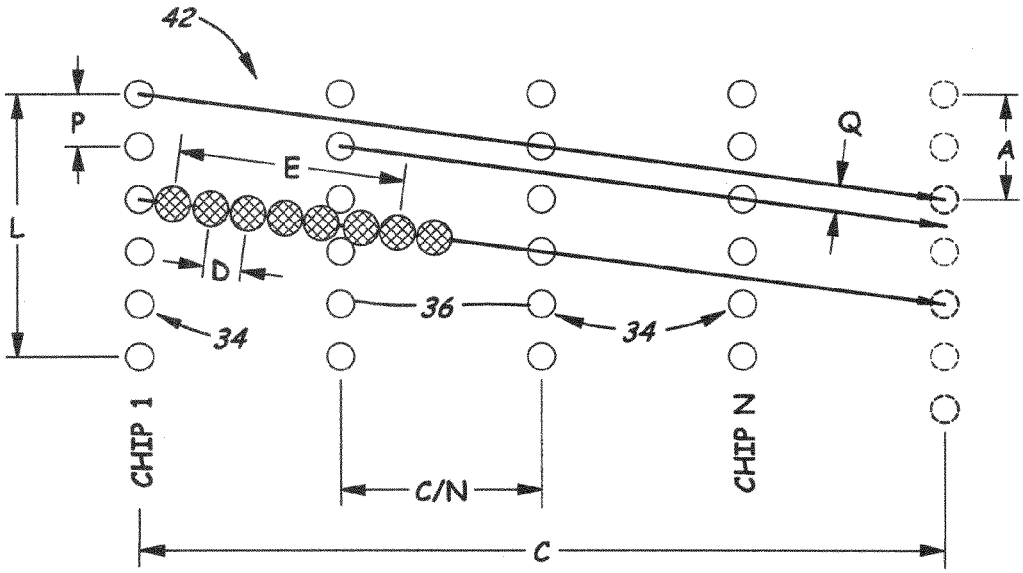

FIG. 5 is a layout of the semi-cylindrical print zone of the rotary inkjet imaging apparatus of the present invention unwrapped into a flat rectangular form to illustrate print grid and nozzle path relationship.

Figure 6:
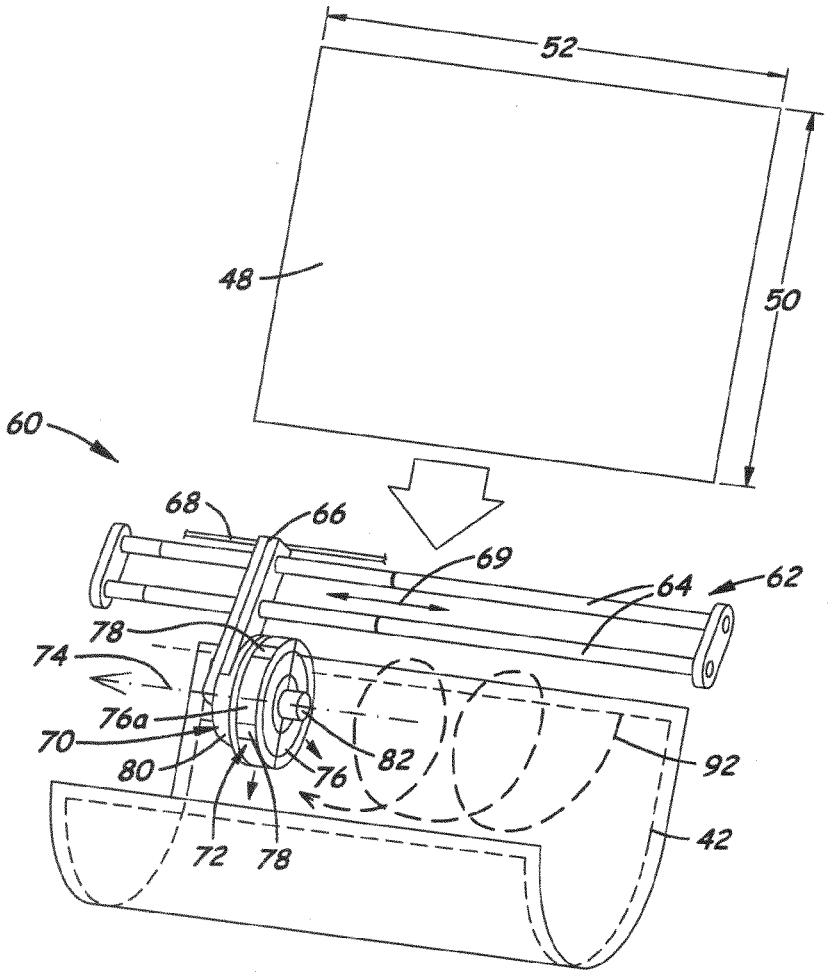

FIG. 6 is a perspective view of another exemplary embodiment of a rotary inkjet imaging apparatus according to the present invention similar to that of FIGS. 1 and 2 except now showing a rotary printhead disc having a plurality of inkjet chips integrated into a single printhead body.

Figure 7:
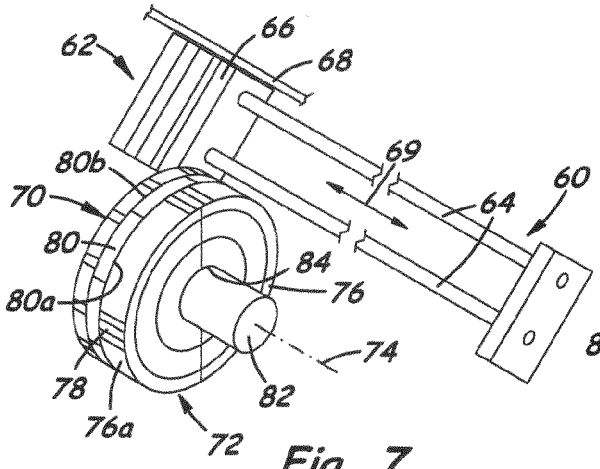

FIG. 7 is an enlarged perspective view of an exemplary embodiment of the printhead carrier assembly of the apparatus of FIG. 6 mounting the rotary printhead disc of the present invention.

Figure 8:
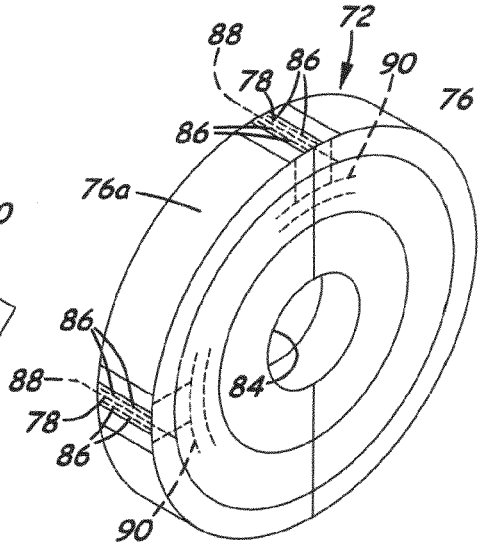

FIG. 8 is an enlarged perspective view of the rotary printhead of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1-3, there is illustrated an exemplary embodiment of a rotary inkjet imaging apparatus, generally designated 10, in accordance with the invention of the above cross-referenced patent application. The apparatus 10 includes a printhead carrier assembly 12 made up of a pair of stationarily-mounted guide members 14, which may be in the form of guide rods, disposed parallel to one another, a carrier 16 mounted for undergoing slideable movement along the guide members 14, and a transport belt 18 movably interconnecting the carrier 16 and a drive motor (not shown) for moving the carrier 16 reciprocally or bi-directionally along the guide members 14. While the carrier 16 is movable bi-directionally along substantially linear path 19, printing occurs only as the carrier 16 moves in one direction, or unidirectionally, as will become clear below.

The carrier 16 has fixedly mounted thereto a platform 20 which, in turn, mounts a holder device 22 for undergoing rotation about a central rotation axis 24. The holder device 22 supports one or more conventional mono or multi-color printheads 26 on a surface 28 of the holder device 22 facing away from the platform 20. The holder device 22 in the exemplary embodiment shown in FIGS. 1-3 has a substantially circular configuration. However, it may as readily have alternative configurations, for example, multiple arms extending radially outward from a central hub, with one printhead 26 mounted on an outer portion of each arm.

Each printhead 26 may take the form of an ink cartridge 30 and a module 32 attached to the cartridge 30 having an array 34 of ink jetting nozzles 36. The cartridge 30 contains ink used during a printing operation and supplies such ink to the nozzles 36. In the case of multiple printheads 26, the arrays 34 of nozzles 36 are spaced apart in a generally symmetrical or balanced relationship about the central axis 24 and the periphery of the holder device 22 with the cartridges 30 positioned inwardly of the modules 32. Each of the printheads 26 is removably and replaceably retained on the holder device 22 by a pivotal retainer cover 38, as seen in FIG. 4.

As the carrier 16 is slidably moved in a substantially linear path along the guide members 14, it carries with it the platform 20, holder device 22 and printheads 26. Concurrently, the holder device 22 is rotated and its printheads 26 rotated with it so as to revolve about the central rotational axis 24 such that each of the printheads 26, as a consequence is advanced along the guide members 14 in a generally curved path, and, in particular, a helical path 40, extending about the central rotational axis 24 which is coaxial with the longitudinal axis of a generally curved print zone 42 and, in particular, a substantially cylindrical print zone 42, defined by a suitable support structure 44 in the imaging apparatus 10. For ease of illustration in FIG. 2 the gap between the print zone 42 and printheads 26 is exaggerated. In actuality, the gap would be very small, only a few millimeters, the same as in the case of conventional inkjet printers. While the holder device 22 is rotating and advancing linearly about the central rotational axis 24 and the printheads 26 are moving along their respective helical paths 40 about and along the central rotational axis 24, the carrier 16 and platform 20 are only linearly driven along the guide members 14 through the length of the cylindrical print zone 42.

The non-rotating platform 20 contains suitable drive mechanisms and circuitry (not shown) for controlling the rotation of the printheads 26 and operation of their ejector nozzle arrays 34. Rotary and linear encoder strips (not shown) are provided on the holder device 22 and guide members 14 that locate the inkjet ejector nozzle arrays 34 relative to the print grid. Sensors (not shown) on the printheads 26 locate the page edges. Print data may be passed to the printheads 26 by means (not shown) consistent with high-speed rotation, for example, an optical link on the rotational axis, a wireless link, or a slipring. Electric power may be passed to the rotating holder device 22 from the platform 20 by a slip ring (not shown). Much of the drive components and control circuitry of the bi-directionally or reciprocally movable inkjet printer disclosed in U.S. Patent Application Publication No. 2006/0066656, assigned to the assignee of the present invention, are applicable also to the imaging apparatus 10. For this purpose, the disclosure of this publication is hereby incorporated herein by reference thereto.

Thus, the ink ejector arrays 34 of nozzles 36 of the inkjet printheads 26 are arranged and oriented to jet ink radially outward from array axes 46 extending substantially parallel to the central rotational axis 24 of the holder device 22 mounting the printheads 24. Inside of the printheads 26 and their ink cartridges 30 are ink compartments (not shown) such that each ink mass distributes itself during acceleration to high speeds so that the holder device 22 tends toward a balanced condition. The holder device 22 rotates and advances with the printheads 26 within the curved, cylindrical print zone 42. A sheet or page 48 is held stationary in a curved configuration within the cylindrical print zone 42 as the printheads 26 move along their respective helical paths 40, winding multiple times or revolutions about the central axis 24, across the width 50 of the page 48 while concurrently advancing along the length 52 of the page 48. Ink drops jet from their ejector nozzle arrays 34 onto the interior surface 48*a* of the curved stationary page 48 within the cylindrical print zone 42 during the portions of the helical paths 40 when the nozzle arrays 34 are facing toward the page 48 and as the carrier 16 moves along its substantially linear path in one direction only or unidirectionally relative to the print zone 42, such as from right to left as viewed in FIG. 2.

With reference now to FIG. 5, there is illustrated a layout of the semi-cylindrical print zone 42 of the rotary inkjet imaging apparatus 10 unwrapped into a flat rectangular diagram for purposes of conceptual simplification to enhance clarity and aid understanding. The diagram assumes that the nozzle array axes 46 are aligned parallel with the central axis 24 of the cylindrical print zone. The relationships among the rotational and advance speeds, the angle of print grid lines across the page of print media, and the number of nozzles that may be used to print a given print grid line will now be described. This will include selecting rotating and advancing speeds to allow multiple nozzles to print a given grid line at desired resolution while maintaining high jetting frequency for each nozzle. After layout, the helical paths which the nozzles traverse become straight lines that move across the print zone at an angle from the horizontal. The line spacing Q can be the ejector pitch (meaning the center-to-center spacing between ejectors) or, for example, one-half, one-third or one-fourth of the ejector pitch. The line angle depends on the distance the printhead advances axially per revolution.

The inclined nozzle paths or lines form the print grid with the nozzle paths being the same as the print grid lines. Each line can be populated with dots at any desired pitch. The identification of the variables is as follows:

A—advance per revolution; C—holder circumference; D—print grid line dot pitch;

E—nozzle ejection pitch; I—print grid lines per nozzle pitch; J—lowest integer number of nozzle pitches an array advances for any integer number of rotations K;

K—lowest integer number of rotations that advance the arrays by an integer number of nozzle pitches J; L—array length in units of nozzle pitch;

M—number of array nozzles; N—arrays on circumference; P—array nozzle pitch;

Q—print grid line spacing; R—holder radius at nozzle plate; $S_\theta$—scan (edge) speed;

$S_z$—axial advance speed; ω—rotation rate (rad/sec); f—jetting frequency; Y—number of arrays that print on a given print grid line during a set of K rotations; and T—total number of nozzles that print on a given print grid line.

The design starts with desired dot and line spacings D and Q, total number of nozzles that print a given print grid line (=number of passes) T, number of arrays N (per color), array length L, nozzle pitch P, circumference C, and desired jetting frequency f. Calculate allowable values for advance per revolution A and derive rotation rate ω, scan speed $S_\theta$ and advance speed $S_z$. The variables are related as follows:

1. Print grid line spacing Q=(P/I)cos(arctan(A/C)), where I is integer number of print grid lines per nozzle pitch P. Roughly, Q=(P/I), so choose I such that I≈P/Q.

2. Choose the lowest integer number of rotations K that advance the arrays by an integer number J of nozzle pitches such that KN/I=Y is an integer. Y is the number of arrays that print on a given print grid line during a set of K rotations.

3. Choose the integer number of nozzle pitches J that an array advances during a set of K rotations by J=int(YL/T).

4. The arrays advance J nozzle pitches during K rotations, so the advance distance per rotation is A=J/K in units of nozzle pitch, or A=(J/K)(P) in units of length.

5. Given dot spacing D and total nozzles T per print grid line, the ejection pitch E (=distance between ejections for a given nozzle) is E=DT.

6. Given desired jetting frequency f, edge speed is $S_\theta$=fE=fDT. Given desired edge speed $S_\theta$, jetting frequency is f=$S_\theta$/(DT).

7. Rotation speed is ω=2π$S_\theta$/C in radians per second or ω=$S_\theta$/C in revolutions per sec.

8. Advance speed is $S_z$=$S_\theta$A/C.

9. Printing time per page=(page length)/($S_z$).

Example One

Two inkjet chips with 312 nozzles per array at 1/600" pitch; desired print grid resolution is roughly (1/1200")×(1/1200"), total number of nozzles per print grid line is 16, jetting frequency=18 kHz, print zone circumference is 20": N=2; L=311; P=1/600"; Q=D=1/1200", T=16. Set I≈P/Q=2 print grid lines per nozzle pitch. Set the lowest integer number of rotations K that advance the arrays an integer number J of nozzle pitches. Choose K such that KN/I=Y is an integer. Since N=2 and I=2, set K=1, so Y=1 also. Then set the integer number of nozzle pitches J the arrays advance during a set of K rotations so that T total nozzles pass over a given print grid line: J=int (YL/T)=int ((1)(311)/(16))=19. Then the advance distance A per rotation is J/K nozzle pitches or JP/K=(19)(1/600)/(1)=0.03167 in. For 1/1200" dot spacing, 16 nozzles per print grid line, and 18 kHz jetting frequency, the rotation edge speed is $S_\theta$=fDT=(18000)(1/1200)(16)=240 in/s. For circumference C=20 in, the rotation speed is $\omega=S_\theta/C$=240/20=12 rev/s. The advance speed is $S_z=S_\theta A/C$=(240)(0.03167)/(20)=0.38 in/s. Printing time per 12 inch page=12/0.38=31.6 sec.

Example Two

For T=8 nozzles per print grid line, choose J=int(YL/T)=int((1)(311)/(8))=38 and the advance distance A per rotation is J/K nozzle pitches or JP/K=(38)(1/600)/(1)=0.06333 in. For 1/1200" dot spacing, 8 nozzles per print grid line, and 18 kHz jetting frequency, the rotation edge speed is $S_\theta$=fDT=(18000)(1/1200)(8)=120 in/s. For circumference C=20 in, the rotation speed is $\omega=S_\theta/C$=120/20=6 rev/s. The advance speed is $S_z=S_\theta A/C$=(120)(0.06333)/(20)=0.38 in/s as before. Printing time per 12 inch page=12/0.38=31.6 sec.

Note that in both these examples the print zone circumference is 20 inches so that two pages can be printed at once. The effective print time for each 1200×1200 dpi page with two such inkjet chips at 18 kHz is 15.8 sec, which is quite fast for this grid resolution.

Compare the foregoing with conventional 8-pass printing with the two chips: Assume the two 600 dpi chips are ganged to make an effective 1200 dpi array. The print swath is (311)(1/600)=0.518 inch. For 8-pass, advance the paper 0.518/8 inch=0.0648 inch per swath, but pass over each swath twice to get 1200 dpi in the scan direction. Maximum swath speed is 30 in/sec. For 8.5 inch swath, print time per swath is 8.5/30=283 ms. For turnaround time, add deceleration and acceleration at 1.5 g=(2)(30)/(1.5)(32.2)(12)=104 ms. Total time for a print pass is 283 ms+104 ms=387 ms. For 12 inch page length, number of swaths is (2)(12.0/0.0648)=370 swaths. At 387 ms per pass and two passes per swath, the conventional printing time for one page is 286 seconds, about 18 times the effective print time per page with the printhead of above Examples One and Two as used in the rotary imaging apparatus 10.

Multi-pass printing may be achieved, in effect, if the ejector arrays advance along the length of the page less than one array length per revolution. In that case a set of several nozzles passes over each print grid line and that print grid line may be printed with that set or a subset of the nozzles chosen randomly. Print speed is maximized because the printhead rotation and advance speeds can be adjusted so that the ejectors operate at rated fluidic frequency, maximizing paint rate even while printing each grid line with multiple nozzles. The surprising result is that multi-pass printing can be done in the same amount of time as single-pass printing. As just seen, the effective paint rate in multi-pass printing by the rotary inkjet imaging apparatus 10 of the present invention can be greatly increased compared to conventional swathing printing.

It will be apparent to those of ordinary skill in the art that the inkjet printheads 26 of the rotary inkjet imaging apparatus 10 of the invention of the above cross-referenced patent application and that of the present invention, as described hereinafter, may utilize diverse technologies, such as thermal, pressurized nozzles, electrostatic fields and/or piezoelectric elements.

Turning now to FIGS. 6-8, there is illustrated another exemplary embodiment of a rotary inkjet imaging apparatus, generally designated 60, according to the present invention. Like the exemplary embodiment of FIGS. 1 and 2, the apparatus 60 includes a printhead carrier assembly 62 made up of a pair of stationarily-mounted guide members 64, which may be in the form of guide rods, disposed parallel to one another, a carrier 66 mounted for undergoing slideable movement along the guide members 64, and a transport belt 68 movably interconnecting the carrier 66 and a drive motor (not shown) for moving the carrier 66 reciprocally or bi-directionally along the guide members 64. While the carrier 66 is movable bi-directionally along substantially linear guide path 69, printing occurs only as the carrier 66 moves in one direction, or unidirectionally.

The carrier 66 has fixedly mounted thereto a platform 70 which, in turn, mounts a rotary printhead disc 72 for undergoing rotation about a central rotation axis 74. The rotary printhead disc 72 is more suitably tailored to the concept of the rotary inkjet imaging apparatus 60 by having a single printhead body 76 and at least one and preferably a plurality of inkjet chips 78. The inkjet chips 78 are integrated into and supported by the printhead body 76 and circumferentially spaced apart from one another about the perimeter of the body 76 and also in a generally symmetrical or balanced relationship to each other about the central rotation axis 74. The rotary printhead disc 72 in the exemplary embodiment shown in FIGS. 6-8 has a substantially cylindrical configuration. However, it may as readily have alternative configurations, for example, multiple arms extending radially outward from a central hub, with one inkjet chip 78 mounted on an outer portion of each arm.

More particularly, the platform 70 has a platen 80 of circular configuration with a central hub 82 of cylindrical configuration extending axially from one side 80*a* of the platen 80 opposite from the other side 80*b* at which the platen 80 is rotatably attached to the platform 70. In the illustrated embodiment, the body 76 of the printhead disc 72 is annular or donut-shaped having a central bore 84 through which the central hub 82 of the platen 80 is inserted for supporting the printhead disc body 76 thereabout. Each inkjet chip 78 may be of conventional design having an array of ink jetting nozzles 86 facing radially outwardly away from the central rotation axis 74 and defined along an axis 88 extending generally parallel to the central rotation axis 74. The inkjet chips 78 are integrated into an endless outer circumferential surface 76*a* of the printhead body 76. The chips 78 are spaced apart from each other and located along and about the endless surface 76*a* of the body 76 and radially outward from the central rotation axis 74. The array of ink jetting nozzles 86 of each chip 78 faces outwardly away from the circumferential surface 76*a* of the body 76 The printhead body 76 further has an interior channel or chamber 90 adapted for containing ink used during a printing operation and connected to the printhead chips 78 to supply ink to the nozzles 86.

As the carrier 66 is slidably moved in the substantially linear guide path 69 along the guide members 64, it carries with it the platform 70, the platen 80, and the rotary printhead disc 72 with the printhead chips 78. Concurrently, the printhead disc 72 is rotated and its printhead chips 78 rotate with it so as to revolve about the central rotation axis 74 such that each chip 78, as a consequence is advanced along the guide members 64 in a generally curved path, and, in particular, a helical path 92 extending about the central rotation axis 74 which is coaxial with the longitudinal axis of the generally curved print zone 42.

The operative relationship between printhead chips 78 of the rotary printhead disc 72 and the print zone 42 is the same as that described heretofore with respect to the embodiment of FIGS. 1 and 2 and so need not be repeated. Also, the platform 70 and platen 80 may contain suitable drive mechanisms, circuitry and other components, such as within the platen's central hub 82, for controlling the rotation of the printhead disc 72 and of the chips 78 therewith. The operation of their arrays of ejector nozzles 86 may be controlled much the same as explained above in connection with the platform 20 and so need not be repeated. Also, the drive components and control circuitry of the inkjet printer disclosed in U.S. Patent Application Publication No. 2006/0066656, assigned to the assignee of the present invention, are applicable to the imaging apparatus 60. The layout of the semi-cylindrical print zone 42 in FIG. 5 also applies to the rotary inkjet imaging mechanism 60 of the present invention.

It should be understood that the foregoing description of one or more embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A rotary inkjet imaging apparatus, comprising:

a curved print zone having a longitudinal axis defined by a page of media having a length and width dimension held during imaging in a curved configuration about said longitudinal axis;

a carrier assembly including a carrier movable bi-directionally along a substantially linear guide path defined adjacent to said curved print zone and extending substantially parallel to said longitudinal axis thereof; and an inkjet printhead disc having a body and at least one printhead chip on a perimeter of said body, said printhead disc body supported by said carrier for undergoing rotation about a central axis and linear movement within said curved print zone along a path parallel to said guide path and coaxial with said longitudinal axis of said curved print zone such that said inkjet printhead disc body rotates about said central axis multiple revolutions and said printhead chip prints on the page concurrently as said carrier unidirectionally moves along said linear guide path and said printhead disc body moves across the length and width dimensions of the held page of media in a single pass of the carrier within said curved print zone and carries said printhead chip through portions of said curved path in which said printhead chip faces toward the page.

2. The apparatus of claim 1 wherein said carrier assembly also includes a platform affixed to said carrier.

3. The apparatus of claim 2 wherein said platform mounts said inkjet printhead disc for undergoing rotation about said central axis relative to said carrier.

4. The apparatus of claim 1 wherein said printhead chip includes an array of ink jetting nozzles facing radially outward away from said central axis and defined along an axis extending generally parallel to said central axis.

5. The apparatus of claim 4 wherein said body of said printhead disc also includes an internal compartment for containing ink and supplying ink to said array of ink jetting nozzles.

6. The apparatus of claim 4 wherein said printhead disc includes a plurality of the printhead chips incorporated in and supported by said body in a spaced apart and generally symmetrical relationship with respect to each other about said central axis.

7. The apparatus of claim 6 wherein said carrier assembly also includes a platform affixed to said carrier and mounting said inkjet printhead disc for undergoing rotation about said central axis relative to said carrier.

8. The apparatus of claim 7 wherein said body of said printhead disc also includes an internal compartment for containing ink and supplying ink to said array of ink jetting nozzles of each of said printhead chips.

9. The apparatus of claim 8 wherein said curved print zone is a substantially cylindrical print zone.

10. The apparatus of claim 9 wherein said curved path of movement of said printhead chips is a generally helical path of movement about said central axis.

11. The apparatus of claim 1 wherein said curved path of movement of said printhead chip is a generally helical path of movement about said central axis.

12. The apparatus of claim 1 wherein said printhead disc includes a plurality of printhead chips circumferentially spaced apart and integrated into said body of said printhead disc, said disc being supported by said carrier so as to provide said printhead chips in a generally symmetrical relationship with respect to each other about said central axis, said curved path of movement of each of said printhead chips being a generally helical path of movement about said central axis.

13. The apparatus of claim 1 wherein said carrier includes a platform having a rotatably supported platen with a central hub extending axially from one side of said platen and supporting said body of said printhead disc thereabout.

14. The apparatus of claim 13 wherein said body of said printhead disc is annular-shaped having a central bore receiving said central hub of said carrier platform platen therethrough.

* * * * *